US006132028A

United States Patent [19]

Su et al.

[11] Patent Number: 6,132,028

[45] Date of Patent: Oct. 17, 2000

[54] CONTOURED ORIFICE PLATE OF THERMAL INK JET PRINT HEAD

[75] Inventors: Wen-Li Su, Vancouver; Jefferson P. Ward, Brush Prairie, both of Wash.

[73] Assignee: Hewlett-Packard Company, Palo Alto, Calif.

[21] Appl. No.: 09/079,446

[22] Filed: May 14, 1998

[51] Int. Cl.[7] ..... B41J 2/14

[52] U.S. Cl. ..... 347/47

[58] Field of Search ..... 347/20, 22, 33, 347/44, 47

[56] References Cited

U.S. PATENT DOCUMENTS 4,413,268 11/1983 Bentin ..... 347/47

5,487,483 1/1996 Kubby ..... 347/47 X 5,595,785 1/1997 Hindagolla et al. ..... 347/47 X 5,786,832 7/1998 Yamanaka et al. ..... 347/47 X

*Primary Examiner*—Sandra Brase

[57] ABSTRACT

An orifice plate for a thermal ink jet print head has a plurality of orifice apertures, with a major surface occupying a first plane. The plate has a surrounding region surrounding each of the orifices, and the surrounding region has an offset portion with an offset surface offset from the first plane. The offset portion may be above or below the first plane, and may include concentric inner and outer regions, with the outer region above the first plane, and the inner region recessed below the outer region.

22 Claims, 5 Drawing Sheets

FIG. 4
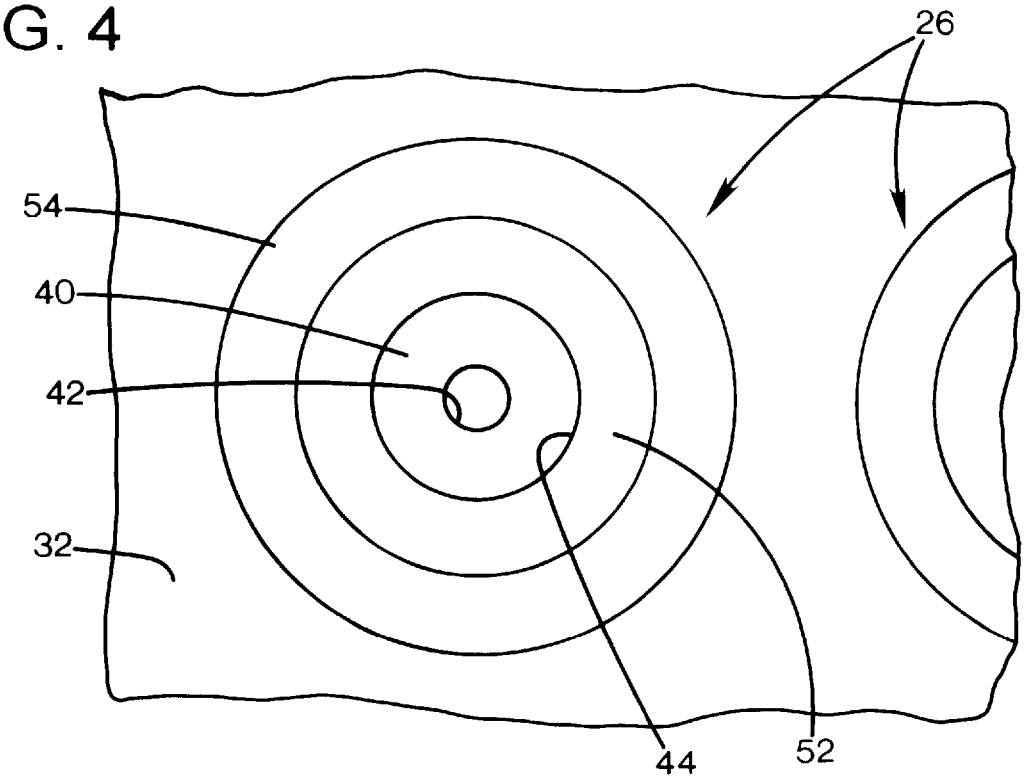
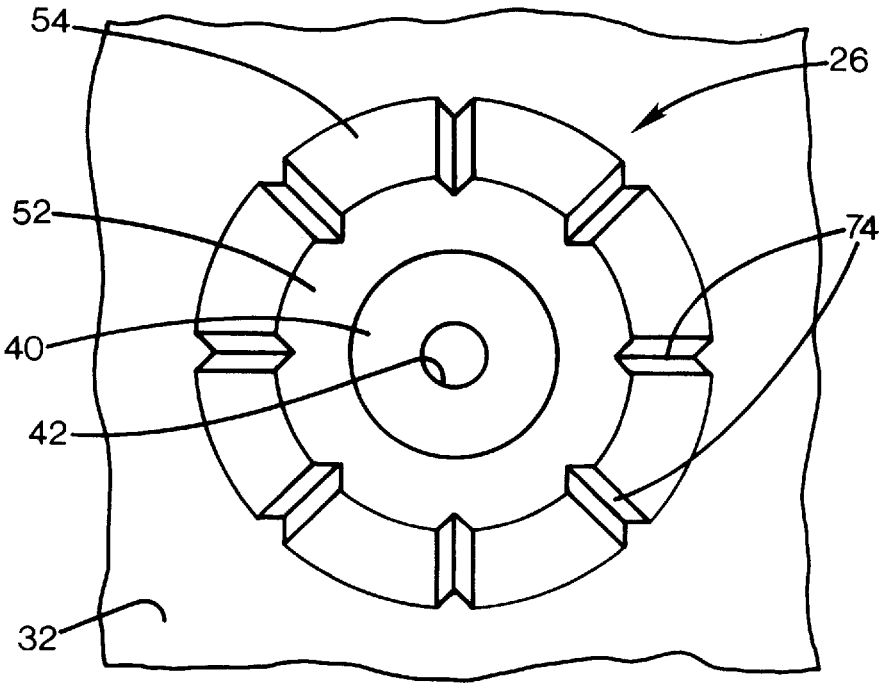
FIG. 5

CONTOURED ORIFICE PLATE OF THERMAL INK JET PRINT HEAD

FIELD OF THE INVENTION

This invention relates to thermal ink jet printers, and more particularly to print head orifice plates for such printers.

BACKGROUND AND SUMMARY OF THE INVENTION

Ink jet printing mechanisms use pens that shoot droplets of colorant onto a printable surface to generate an image. Such mechanisms may be used in a wide variety of applications, including computer printers, plotters, copiers, facsimile machines, and other printing mechanisms. For convenience, the concepts of the invention are discussed in the context of a printer. An ink jet printer typically includes a print head having a multitude of independently addressable firing units. Each firing unit includes an ink chamber connected to a common ink source via channels in a substrate, to an ink outlet nozzle or orifice defined in a thin metal orifice plate common to all nozzles on a print head. In some configurations, a three color pen has three different channels running parallel to each other and nearly spanning the entire substrate.

Ink jet print heads are susceptible to performance problems if contaminants build up on the orifice plate surface. Ink droplets may collect on the surface adjacent to the orifices, causing expelled droplets to be diverted by the presence of a droplet near one edge of the orifice. A build up of droplets may lead to puddling on the surface. If the puddling is extensive, it may provide a capillary path between nozzles of different colors, causing cross contamination or color intermixing that may extend into the ink supplies, as ink from a higher pressure supply migrates to a lower pressure supply. With extensive puddling, nozzles may become covered with ink, causing either a malformed or misdirected droplet, or preventing droplet ejection entirely. In addition, particles such as paper fibers may accumulate on the surface, partially or fully blocking a nozzle.

Accordingly, it has been customary to employ a flexible wiper to occasionally wipe across the surface of the orifice plate to remove debris and excess ink. Wipers also serve to prime firing units that are low on ink by contacting the surface of the orifice with an entrained ink film that draws ink up from the nozzle by way of capillary action. While generally effective, such wipers have several disadvantages. A wiper may serve as a vehicle to for color intermixing, as it wipes a puddle or dried ink particles from the nozzles of one color to the nozzles of another color. The orifice plate may be enlarged to reduce proximity between nozzles of different colors, but this increases the size and cost of the orifice plate. Wipers also may accrete debris or dried ink, which may further cause intermixing, and which may clog orifices or otherwise impair wiping effectiveness.

Wiping also may cause degradation of the orifice plate by the wearing action of the wiper. With non-metallic orifice plates such as those formed of polyimide (e.g. Kapton) film, the edges of an orifice may become abraded by wiping action. The edge may also become "ruffled," with flakes of material peeling slightly upward on an edge of the orifice. Any orifice wear or damage can cause droplets to be deflected from their intended path, impairing print quality.

Selection of wiper materials has traditionally faced a trade off of several factors, including wiper durability, orifice plate wear, and wiper effectiveness. For instance, a harder wiper material may provide high local pressures for effective scraping of contaminants, but at the cost of increased orifice plate wear. A soft material may not cause wear, but may be susceptible to wear that degrades wiping performance over time.

For efficient ink jet printing without excessive energy consumption, the volume of ink in the firing chamber should be minimized, reducing the ink mass to be moved upon firing, thus creating a more responsive firing characteristic. One factor affecting this volume is the height of the firing chamber, defined by the distance between the resistor film at the base of the chamber and the upper surface of the orifice plate, which normally defines the upper edge of the nozzle. To reduce volume by reducing plate thickness has the disadvantage of weakening plate strength and rigidity, making assembly more difficult, and potentially impairing reliability.

Therefore, there exists a need for an ink jet print head that overcomes or reduces at least some of these disadvantages. The disclosed embodiments address this need by providing an orifice plate for a thermal ink jet print head. The plate has a plurality of orifice apertures, with a major surface occupying a first plane. The plate has a surrounding region surrounding each of the orifices, and the surrounding region has an offset portion with an offset surface offset from the first plane. The offset portion may be above or below the first plane, and may include concentric inner and outer regions, with the outer region above the first plane, and the inner region recessed below the outer region.

DESCRIPTION OF THE DRAWINGS

FIG. 4 is an enlarged plan view of the print head of FIG. 1.

FIG. 5 is an enlarged plan view of a print head according to an alternative embodiment of the invention.

DETAILED DESCRIPTION OF A PREFERRED EMBODIMENT

Figure 1:
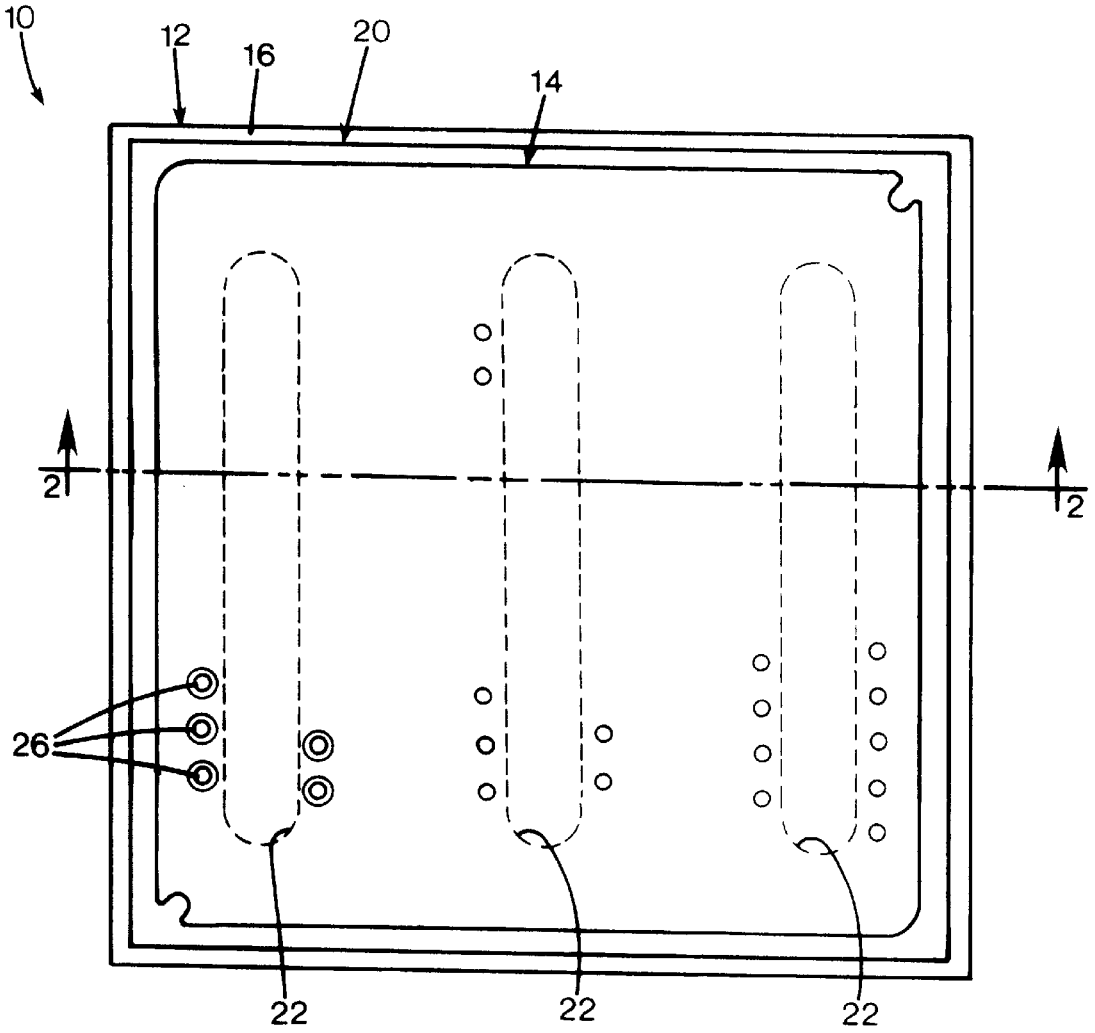
FIG. 1 is a plan view of an ink jet print head according to a preferred embodiment of the invention.
Figure 2:
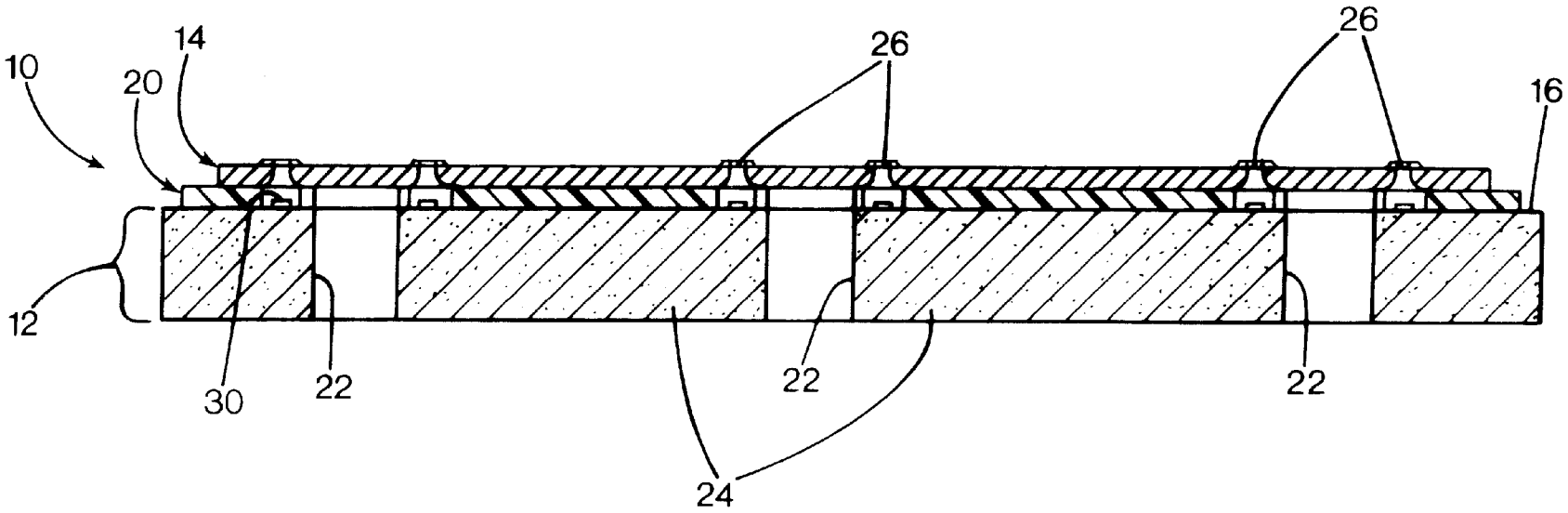
FIG. 2 is a sectional side view of the print head of FIG. 1 taken along line 2—2.

FIGS. 1 and 2 show an ink jet print head 10 having a planar silicon die 12 providing a substrate for a metal orifice plate 14, which is laminarly adhered to a front surface 16 of the die with a polymeric barrier film layer 20. In an alternative embodiment, the barrier and orifice plate may be integrated as a single part formed of a single material. The die 12 defines three elongated ink channels 22 that are spaced apart on the die, and which pass entirely through the thickness of the die to communicate with corresponding separate color ink reservoirs connected at the rear of the die. The plate 14 defines a row of ink orifices 26 on each side of each channel 22. For each channel, the rows on opposite sides are offset from each other so that an evenly spaced swath of densely printed droplets may be printed by firing all orifices on both sides.

The barrier layer 20 is coextensive with the die 12 and plate 14, except that it defines openings registered with the ink channels 22, with pockets extending away from the channel, one for each orifice 26. A firing resistor 30 on the front surface of the die is positioned beneath each orifice.

Figure 3:
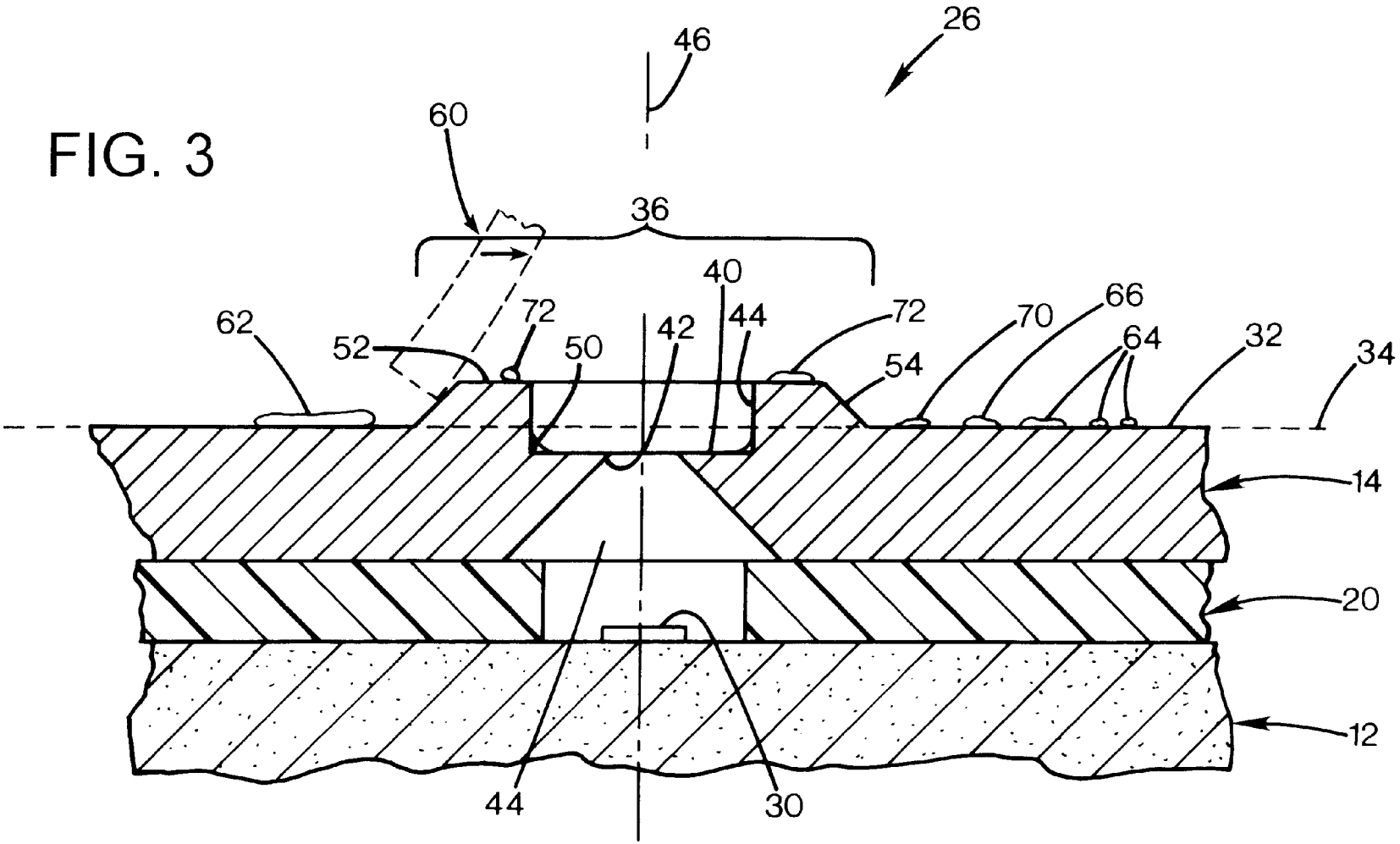
FIG. 3 is an enlarged sectional side view of the print head of FIG. 1.

FIGS. 3 and 4 show enlarged views of the nozzle 26. The orifice plate has a major upper surface 32 defining a first plane 34. A surrounding region 36 of the plate has a contoured surface that departs from the first plane 34. The surrounding region includes several concentric elements. A flat recessed annular surface portion 40 immediately surrounds the orifice aperture 42, which provides access into the firing chamber 44, and through which ink droplets are expelled. The recessed surface is at a level below the first plane 34, so that the volume of the firing chamber is reduced relative to a flat orifice plate with an aperture at the first plane. This also permits the plate strength to be defined by the thicker main portions.

The recessed surface 40 is parallel to the first plane, and bounded by a cylindrical side wall 44 that extends perpendicularly to the first plane, centered on the nozzle axis 46. The recessed surface 40 joins the side wall 44 at a sharp interior corner 50 that has little or no radius. This provides a capillary effect for ink on the recessed surface, effectively serving as a reservoir for ink puddles, by drawing them away from the edges of the orifice to prevent impaired printing.

The recess 40 is encircled by an elevated surface 52, which is a flat annular ring at a level above the first plane 34. The elevated surface is surrounded by a frustoconical skirt 54 that provides a sloped transition between the elevated surface and the plate's major surface 32. The elevated surface meets the skirt at an angle providing a circular edge. As a result, any accreted debris or dried ink on a wiper 60 passing over the nozzle may be at least in part scraped off by the edge before passing over the orifice. As illustrated, the upper surface of the orifice plate carries an ink puddle 62, droplets 64, fiber debris 66, and dried ink 70. Because these elements are positioned well away from the nozzle, they may be tolerated without harming printing functions. As they are below the level of the elevated surface 52, the wiper 60 may be positioned so that it contacts the elevated surface to remove droplets 72, without contacting the lower contaminants. This prevents the wiper from dragging substantial debris or intermixed ink onto a nozzle. To assist in the precise positioning of the wiper blade so that it contacts the elevated portion but not the main surface, sets of elevated rails (not shown) may be formed on the main surface, and oriented along the direction of wiping motion and perpendicular to the wiper edge. The wiper would slide along these rails, just above the main surface, and contacting the higher elevated portions at the nozzles.

Because the orifice aperture 42 is positioned below the reach of the wiper, it is not susceptible to abrasion by the wiper. This allows use of more robust wiper materials, reducing wiper wear. In addition, because the wiper has only a small area of contact, wiping only the regions immediately surrounding the nozzle, a locally high wiping pressure may be obtained without high total wiper forces. A high wiping pressure provides increased effectiveness at removing firmly affixed contaminants such as dried ink.

In the preferred embodiment, the die 12 has a thickness of about 600 $\mu$m and sides of length 7855 $\mu$m by 8685 $\mu$m. The channels 22 are 5690 $\mu$m long and 300 $\mu$m wide. The entire print head has 192 resistors, with 32 being spaced in a row on each side of each ink channel at a pitch of 150 per inch. The barrier is formed of a polyimide material, and is 19 $\mu$m thick. The plate 14 is a palladium-coated nickel plate of 50 $\mu$m thickness between its lower surface and major upper surface. The elevated portion 52 is 25 $\mu$m above the first plane 34, and the recessed surface 40 is 25 $\mu$m below the first plane. The orifices 42 have a diameter of 60 $\mu$m, the recessed surface a diameter of 60 $\mu$m, the elevated surface an outer diameter of 120 $\mu$m and the skirt a diameter of 170 $\mu$m. These values may be varied widely for alternative embodiments and alternative ink chemistries.

FIG. 5 shows an alternative embodiment in which the skirt portion 54 is provided with a set of evenly spaced radial grooves 74. These provide a capillary path for large droplets on the elevated surface 52 to migrate to the main surface 32. The grooves have sharp, V-shaped cross sections, although a square channel or any other shape having sharp or minimally radiused corners may be substituted. The grooves terminate before reaching the recessed portion to avoid bringing contaminated ink into proximity with the orifice. The grooves are typically 10 $\mu$m wide.

Figure 6:
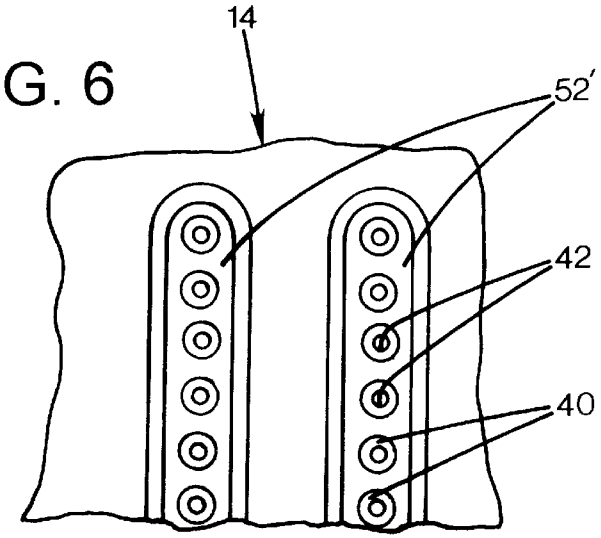
FIG. 6 is an plan view of a print head according to a second alternative embodiment of the invention.

FIG. 6 shows an alternative orifice plate 14' having orifice rows sharing common elevated surfaces 52'. Each nozzle orifice 42 is surrounded by its own recessed surface 40. Each row sharing a common elevated surface is devoted to a single ink color, so that puddling or migration of droplets across the elevated surface will not lead to inter-color mixing. Adjacent rows of different color inks may be positioned relatively close together, permitting a smaller orifice plate and print head.

Figure 7:
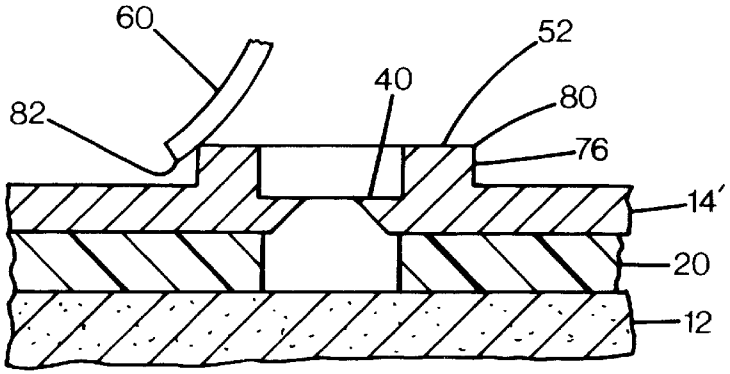
FIG. 7 is an enlarged sectional view of a print head according to a third alternative embodiment of the invention.

FIG. 7 shows a further alternative embodiment in which the elevated portion 52' of the orifice plate 14' is surrounded by a perpendicular cylindrical wall 76. This presents a sharp upper peripheral edge corner 80, which is effective to scrape debris and contaminants 82 from the wiper 60. This also ensures that the wiper is scraped immediately prior to passing over the orifice, reducing the chances that a contaminant wiped from another surface will be deposited at the orifice.

Figure 9:
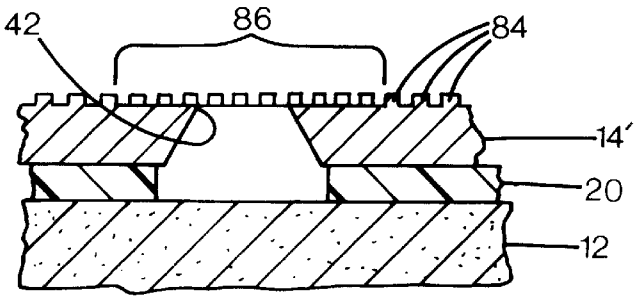
FIG. 9 is an enlarged sectional view of a print head according to the embodiment of FIG. 8.
Figure 8:
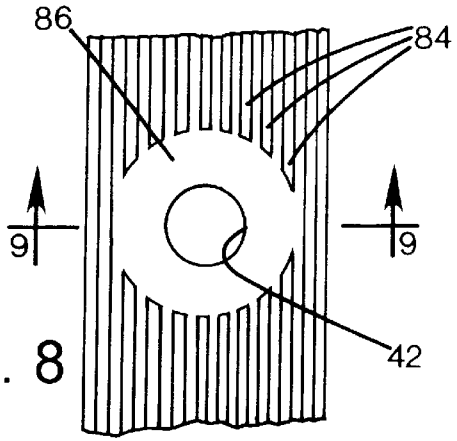
FIG. 8 is an enlarged plan view of a print head according to a fourth alternative embodiment of the invention.

FIGS. 8 and 9 show an additional alternative embodiment in which the orifice plate 14" is generally flat, and has an array of ridges 84 covering substantially the entire surface, except for an annular zone 86 immediately surrounding each orifice. This embodiment operates on the principle that ink droplets will tend to migrate toward the capillaries formed by the ridges. A puddle touching the ridges will be drawn into the ridge zone, and dispersed along the channels between the ridges. This prevents large puddles from protruding substantially above the surface. The ridges preferably are aligned with rows of similar-color nozzles, so the ink migration along the ridges does not lead to intermixing. The reluctance of ink to migrate across the ridges permits a row of different-color nozzles to be positioned relatively closely, achieving the advantages discussed above with respect to the embodiment of FIG. 6. The ridges further assist with cleaning of the wiper prior to its encounter with the orifice, and the annular zone being recessed below the ridge peaks protects it from direct contact and damage by the wiper. An alternative embodiment may substitute a textured or relatively wettable surface for the ridges, creating ink affiliation away from the nozzles.

While the above is discussed in terms of preferred and alternative embodiments, the invention is not intended to be so limited. In particular, the features of different embodiments may be combined, or used independently. For instance, the ridges of FIG. 8 may be used to cover the flat main surface in any other embodiment; the elongated elevated portions of FIG. 6 may be combined with the sharp-edged rise of FIG. 7.

What is claimed is:

1. An orifice plate for a thermal ink jet print head comprising:

a planar plate defining a plurality of orifice apertures;

the plate having a major surface occupying a first plane;

the plate having a surrounding region surrounding one of the orifices;

the surrounding region having an offset portion with an offset surface offset from the first plane; and wherein the surrounding region includes a second portion offset from the offset portion.

2. The orifice plate of claim 1 wherein the offset portion is elevated above the first plane.

3. The orifice plate of claim 1 wherein the offset portion surrounds at least one of the orifices.

4. The orifice plate of claim 1 wherein the offset portion is an annular ring.

5. The orifice plate of claim 1 wherein the offset portion surrounds the second portion and the second portion surrounds the orifice.

6. The orifice plate of claim 5 wherein the second portion is at a level recessed below the offset portion.

7. The orifice plate of claim 1 wherein the surrounding region includes an inner portion surrounding the orifice, and an outer portion surrounding the inner portion, the inner portion being recessed with respect to the outer portion.

8. The orifice plate of claim 1 wherein the second portions is a sloped surface between the major surface and the offset portion.

9. The orifice plate of claim 8 wherein the sloped surface defines a groove.

10. An ink jet print head comprising:

a substrate;

a planar orifice plate connected to the substrate and defining a plurality of orifice apertures;

the orifice plate having a major surface facing away from the substrate; and the orifice plate having an elevated region surrounding a plurality of the orifices.

11. The print head of claim 10 including a plurality of recessed regions, each surrounding at least one of the orifices, and each surrounded by one of the elevated regions, the recessed regions being recessed with respect to the elevated regions.

12. The print head of claim 11 wherein the recessed regions are recessed with respect to the major surface.

13. The print head of claim 11 wherein at least some of the recessed regions include a first surface bounded by a second surface intersecting the first surface at an angled corner.

14. The print head of claim 10 including a sloped surface between the major surface and each elevated region.

15. The print head of claim 14 wherein the sloped surface defines a groove.

16. The print head of claim 10 wherein the periphery of the elevated region is defined by a side wall angularly offset from the recessed region.

17. The print head of claim 16 wherein the side wall is substantially perpendicular to the elevated region.

18. A method of wiping an orifice plate of an ink jet print head having a orifice plate defining a plurality of orifices, the plate having a planar major surface, and at least some of the orifices being surrounded by a surrounding surface portion elevated above the major surface, the method comprising the steps:

moving a flexible wiper over the orifice plate;

while moving the wiper, maintaining the wiper spaced apart from at least a portion of the major surface; and while moving the wiper, wiping each of the elevated surrounding portions.

19. An orifice plate for a thermal ink jet print head comprising:

a planar plate defining a plurality of orifice apertures;

the plate having a major surface occupying a first plane;

the plate having a surrounding region surrounding one of the orifices;

the surrounding region having an offset portion with an offset surface offset from the first plane; and the plate defining a groove extending from the offset surface to the major surface.

20. The orifice plate of claim 19 wherein the offset portion surrounds a plurality of the orifices.

21. The orifice plate of claim 19 wherein the surrounding region includes a second portion offset from the offset portion.

22. The orifice plate of claim 19 wherein the second portion is a sloped transitional surface between the major surface and the offset surface, and wherein the groove is defined in the transitional surface.

* * * * *